United States Patent [19]

Greschbach

[11] 4,387,760

[45] Jun. 14, 1983

[54] SLIDING FOLDING DOOR

[76] Inventor: Manfred Greschbach, Eisenbahnstrasse 44, D-7834 Herbolzheim, Fed. Rep. of Germany

[21] Appl. No.: 117,624

[22] Filed: Feb. 1, 1980

[30] Foreign Application Priority Data

Feb. 1, 1979 [DE] Fed. Rep. of Germany ..... 2903745

[51] Int. Cl.[3] ..... E06B 3/48

[52] U.S. Cl. ..... 160/229 R; 160/199

[58] Field of Search ..... 160/229 R, 232, 220, 160/183, 185, 199

[56] References Cited

U.S. PATENT DOCUMENTS

| | | | |
|---|---|---|---|
| 2,311,470 | 2/1943 | Ritter | 160/229 R |
| 2,331,512 | 10/1943 | Siedschlag | 160/232 X |
| 2,952,313 | 9/1960 | Stroup | 160/229 R |
| 3,229,751 | 1/1966 | Moorer | 160/185 |
| 3,233,277 | 2/1966 | Hirashiki | 160/229 R |
| 3,297,077 | 1/1967 | Garbus | 160/231 |
| 3,359,594 | 12/1967 | Pastoor | 160/199 |
| 3,385,344 | 5/1968 | Andrews | 160/206 |
| 3,949,801 | 4/1976 | Sasaki | 160/229 R |

FOREIGN PATENT DOCUMENTS

| | | | |
|---|---|---|---|
| 808085 | 1/1959 | United Kingdom | 160/232 |

*Primary Examiner*—Peter M. Caun
*Assistant Examiner*—Cherney S. Lieberman
*Attorney, Agent, or Firm*—Paul M. Craig, Jr.

[57] ABSTRACT

A sliding folding door of double-walled construction with the sliding door including a plurality of leaves interconnected by shaped connecting rails. The doors are adapted to be foldable or pivotable about vertically extending pivots disposed inside the connecting rails. Each of the connecting rails includes two cylindrical walls that have a quarter-circle cross section and extend along the connecting rail, with center points of their radius of curvature being arranged in the pivots. Each cylindrical wall has opposed thereto a crosspiece that extends along a long side of the respective door leaves.

13 Claims, 3 Drawing Figures

SLIDING FOLDING DOOR

The invention relates to a sliding folding door whereof the double-walled leaves are interconnected by shaped connecting rails, about two vertical pivot shafts disposed inside the connecting rails.

The proposed invention finds application in two- three- or multi-leaved sliding folding doors for industrial workshops and large garages.

Considering the fact that there is an increasing energy scarcity and rising energy costs, the connecting or pivot points between the leaves of sliding folding doors are considered to be more and more of a problem. While there has been success in satisfactorily improving the thermal insulation of double-walled door leaves, there is still much to be desired in controlling the loss of heat through the gaps provided at the places of connection of the door leaves. These long gaps so far have not been sealed satisfactorily in any of the various known folding door constructions so that, especially when there is strong air movement, substantial thermal losses occur through the gaps. In addition, sufficient attention has frequently not been paid to the danger of accident, in the design of the connection and pivot places. Thus far the requirement that the unavoidable gaps at these points be so small that even children will not get their fingers caught has been inadequately met in many instances.

A multi-leaf sliding folding door is known from German Pat. No. 1,509,252 in which the leaves are articulatedly interconnected by means of cover strips having a U-shaped cross-sectional configuration, with the pivot axis of the leaves being within an outline of the cover strips. The proposed design of the long edges of the door leaves and of the cover strips, for technical reasons, is not suitable for avoidance of the disadvantages inherent in the long gap that is needed, between the pivotable parts.

The invention deals with the problem of designing a sliding folding door in such a way that the long gap at the pivot point between the door leaves will be acceptably sealed in the closed position, and also in such a way that the gaps will be so small in any pivot position of the leaves so as to rule out any possibility of an accident caused by inserting fingers or the like into such gaps.

The problem is solved in accordance with the present invention by a sliding folding door having a connecting rail provided between the respective door leaves with each connecting rail including two cylindrical walls having cross section of a quarter circle, extending along the connecting rail with a center of the radius of curvature of the cylindrical walls being disposed in the pivot axis. A crosspiece is disposed along the long side of the door leaf opposite each cylindrical wall. These cylindrical walls have a constant curvature and, in conjunction with the opposite crosspiece, have the effect that the gap at the pivot place can be made almost arbitrarily small, and the gap remains the same in any position of pivoting of the door leaf so that there is an excellent seal as well as avoidance of the risk of accidental injury.

In a preferred embodiment of the invention, each connecting rail is also provided with two additional quarter-circle cylindrical walls extending lengthwise of the connecting rail, with the center of their respective radius of curvature also being disposed in the pivot axes. Two additional crosspieces respectively lie opposite the additional cylindrical walls. By this means, the seal is additionally improved because, in this way, each pivot point has two gaps one behind the other that enclose an air cushion. Moreover, with suitable proportions, an identical appearance of the inside and outside of the sliding folding door can be produced.

For structural and also for visual reasons, the crosspieces advantageously are on the outer and inner walls respectively of the door leaf. Advantageously, the cylindrical walls are connected by crosspieces.

An insulating material can be disposed between the cylindrical walls and, advantageously, packing strips are disposed along the crosspieces.

According to another important characteristic of the invention, the elongated end of the cylindrical wall, in the closed position of the door leaf, abuts a sealing cushion or sealing pad fixed to the inner or outer wall of the door leaf. This sealing cushion serves as a stop to limit the pivoting movement of the door leaf in its open position and acts as a supplementary sealing means, because of an air cushion between the two gaps, disposed one behind the other, which is divided into two parts.

A division of the air cushion in the pivot place into three parts, and therewith a further improvement of the seal and thermal insulation can be produced by a special design of the pivot articulation, in that strips are shaped onto the end pivot pins of the connecting rails which turn in a sleeve shaped on the inner or outer wall of the door leaf, said sleeve presenting a longitudinal slit.

The invention is illustrated in the attached drawing of an example of embodiment and is discussed below with reference to this drawing.

Figure 1:
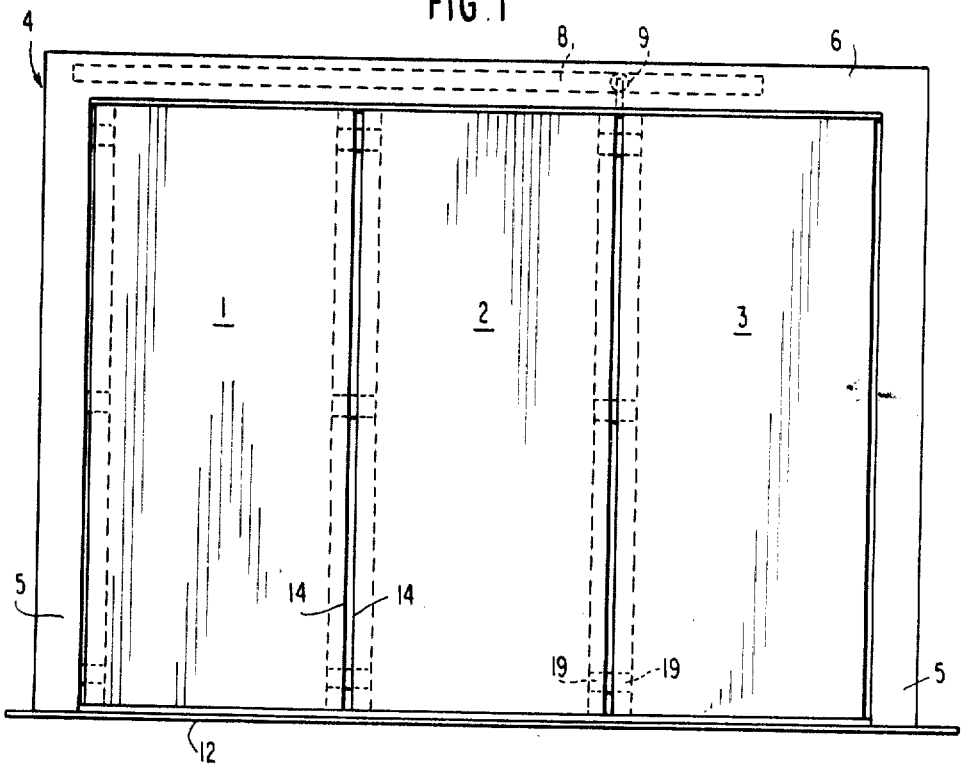
FIG. 1 is a front view of a three-leaf sliding folding door, with the leaves being connected by a connecting rail in accordance with the present invention.
Figure 2:
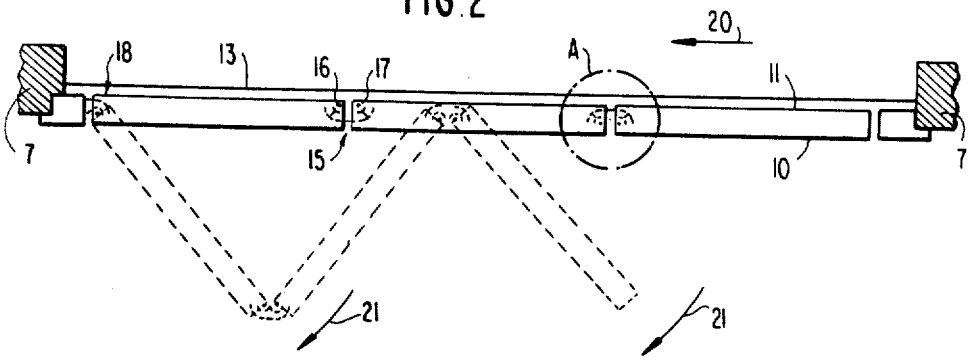
FIG. 2 is a partially schematic horizontal cross sectional view illustrating the sliding folding door of FIG. 1 in a closed position and, in phantom line, in a half-opened position.

Referring now to the drawings wherein like reference numerals are used throughout the various views and, more particularly, to FIGS. 1 and 2, according to these Figures, a sliding folding door includes three leaves 1, 2 and 3 disposed adjacent to one another in a vertical door frame 4. The two uprights 5 and the transom 6 comprise shaped steel pieces and are fixedly connected with the building wall 7. A supporting rail 8 is provided in transom 6 wherein supporting rollers 9 run, on which door leaves 2 and 3 are rotatably suspended. The three door leaves 1, 2 and 3 are double-walled, whereby outer wall 10 and inner wall 11 are made of sheet steel, between which thermal insulating material is provided. When the door is closed inner walls 11 are applied or abut (see FIG. 2) against a stop rail 13 secured to the floor 12. A corresponding stop rail (not shown) is also provided on an underside of the transom 6.

The three door leaves 1, 2 and 3 are interconnected on their long sides 14 that are opposite each other by means of shaped connecting rails generally designated by the reference numeral 15, so as to be swingable respectively about two vertical pivot shafts 16 and 17 disposed inside the shaped connecting rails 15. A corresponding connecting rail generally designated by the reference numeral 18 is provided between the first door leaf 1 and door frame upright 5 for pivotably fastening the door leaf 1 to the upright 5. As shown in FIG. 1, the connecting rails 15 are in pivotable connection with door leaves 1, 2 and 3 by means of hinges 19 disposed at three different heights. When the sliding folding door is opened, door leaves 1, 2 and 3 move in the direction indicated by the arrow 20 and, at the same time door leaves 1, 2 and 3 pivot in the direction indicated by arrows 21 toward each other and also forward out of door frame 4 toward the front illustrated in dashed lines in FIG. 2, until the leaves 1, 2, 3 are close together, parallel, and perpendicular to the plane of door frame 4 secured on a wall 7 of a building.

Figure 3:
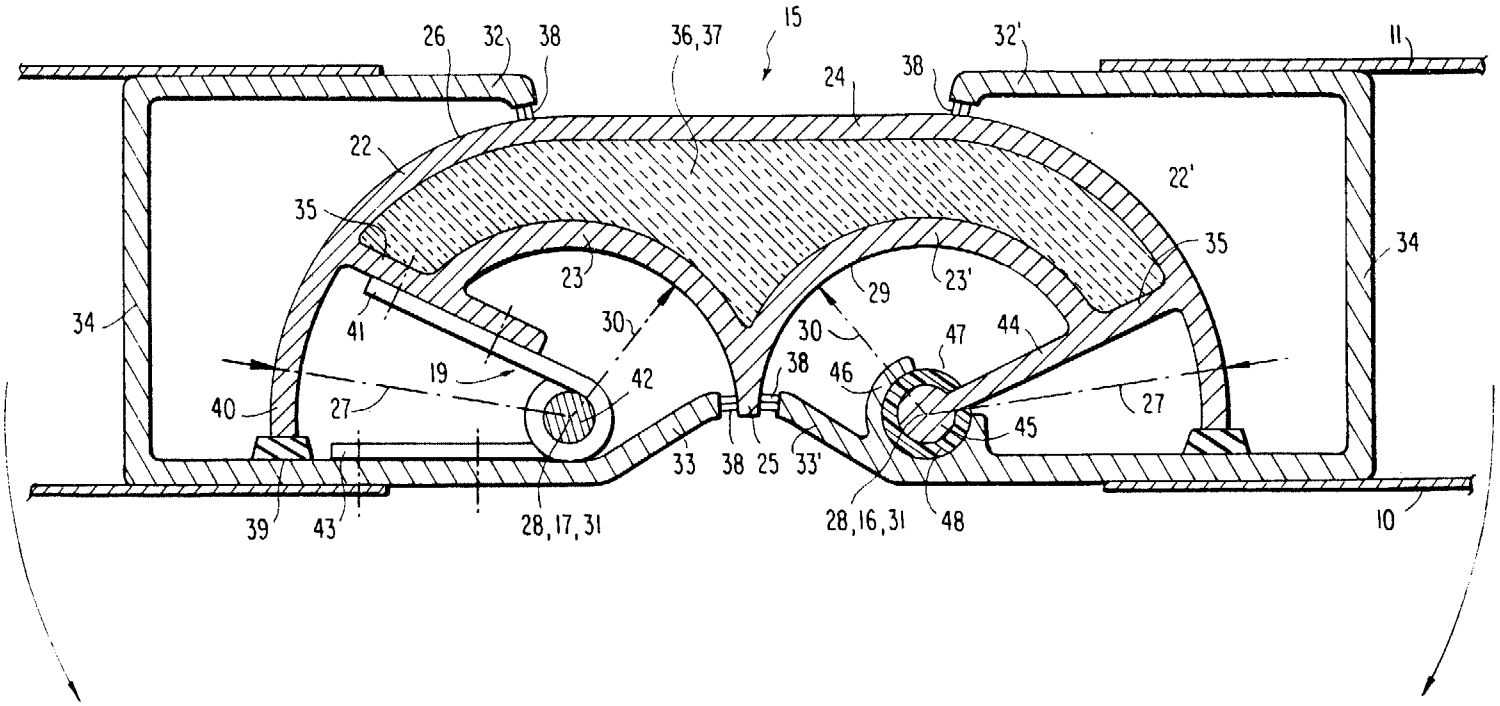
FIG. 3 is an enlarged cross sectional view of the detail designated A in FIG. 2 of a connecting rail in accordance with the present invention, depicting the connecting rail in more or less actual size.

As shown most clearly in FIG. 3 the shaped connecting rail 15 according to the invention is made of extruded aluminum and includes two cylindrical walls 22, 22' which have a quarter-circle cross section, and two other cylindrical walls 23, 23' which likewise have a quarter-circle cross section. All cylindrical walls 22, 22' and 23, 23' extend in the longitudinal direction of connecting rail 15, and are interconnected in pairs along their long edges. In the case of cylindrical walls 22, 22', the connection is effected with a smooth transition by way of a straight connecting piece 24; whereas, in the case of cylindrical walls 23, 23', there is an acute-angled narrow joint 25 between them. The two cylindrical walls 22 and 22' have the same radius of curvature 27 on the outside and a center 28 of the curvature of the respective cylindrical walls 22, 22' is located in the pivot shafts 16 and 17. The other two cylindrical walls 23 and 23' have a radius of curvature 30 that is also corresponding on their inside surface 29, with the centers 31 of the curvature of the walls 23, 23' being respectively located in pivot shafts 16 and 17. As shown in FIG. 3, the radius of curvature 27 is greater than radius of curvature 30.

The long sides 14 of the respective leaves 1, 2, 3 are formed of extruded aluminum U-shaped pieces 34, with the inner wall 11 and outer wall 10 being fastened to the legs of the U-shaped piece 34. The legs of the U-shaped piece 34 terminate, as shown in FIG. 3, in crosspieces 32, 32' and 33, 33' with the ends of the crosspieces 32, 32' and 33, 33' being disposed at a slight distance from and opposed to the two pairs of cylindrical walls 22, 22' and 23, 23', disposed along the long sides 14 of the door leaves 1, 2 and 3. The crosspieces 32, 32', 33 and 33' are applied to outer wall 10 or inner wall 11 of door leaves 1, 2 and 3, and they are essentially in the plane of outer wall 10 and inner wall 11. If radius of curvature 30 is selected to be substantially smaller than radius of curvature 27 and at the same time joint 25 is widened by a connecting piece (not shown), then the distance between pieces 32 and 32' and pieces 33 and 33' can be made equal, which means that the front and back of the closed sliding folding door will have an identical appearance.

Cylindrical walls 22, 22' and 23, 23' are interconnected by crosspieces 35, whereby a cavity 36 is produced between cylindrical walls 22, 22' and 23, 23' wherein there is provision of insulating material 37.

Sealing strips 38 are disposed along the free ends of pieces 32, 32', 33, 33'. The sealing strips 38 include long narrow brushes that are thrust or clamped in grooves (not shown) provided at the free ends of the respective crosspieces 32, 32', 33, 33'.

Sealing pads 39 are fastened on inner walls 10 of leaves 1, 2 and 3 that extend along the whole long side 14 of said leaves 1, 2 and 3. Cylindrical walls 22, 23' terminate in a short extended end section 40 which, in the closed position of leaves 1, 2 and 3 of the door, abut against sealing pads 39 and are sealingly applied thereto.

One hinge plate 41 of the hinges 19 that serve for pivotable connection of connecting rails 15 with leaves 1, 2 and 3 of the door is screwed on a crosspiece 35 or on an extension that projects beyond cylindrical wall 22. The other hinge plate 43 is screwed to the leg of the U-shaped connecting piece 34 or on crosspiece 33. The hinge plates 41, 43 are connected for pivotable movement by a pin 42. In another embodiment of this joint shown in the right-hand side of FIG. 3 in the region of cylindrical wall 23' and crosspiece 33', instead of the hinges 19' a strip 44 is shaped on connecting rail 15 as an extension of crosspiece 35, which strip 44 supports a pin 45 at the free end thereof, with the pin 45 likewise being shaped on the strip 44. This pin 45 is rotatably seated in a sleeve 46 shaped on outer wall 10 of leaf 1, 2 or 3 or on crosspiece 33'. The sleeve 46 includes a longitudinal slit 47 that has a center angle of at least 90°. The pin 45 is surrounded at a number of places distributed over the long side 14 of the leaves 1, 2, or 3 by a slitted bearing shell 48 made of a plastic material, whereby lubrication of this joint becomes superfluous.

I claim:

1. A sliding folding door comprising a plurality of door leaves, each of said door leaves being of a double-walled construction and including inner and outer walls, shaped connecting rail means connecting adjacent door leaves to each other by way of vertically extending pivot means disposed in the connecting rail means, said pivot means enabling the respective leaves to be pivotable relative to one another about two laterally spaced vertical pivot shafts, wherein each connecting rail means includes a pair of laterally spaced cylindrical first walls which are nonrotatably connected to said connecting rail means, each of the cylindrical first walls having an arcuate length of approximately a quarter-circle and a radius of curvature having a center point arranged in the pivot means, and in that a pair of first crosspieces are connected to and extend along a long side of the respective leaves of the door from one of said inner and outer walls, one of said first crosspieces is disposed opposite one of the first cylindrical walls in close spaced relationship and the other of the first crosspieces is disposed opposite the other of the first cylindrical walls in close spaced relationship so that any gaps between the pivot means and the adjacent door leaves remain small in any position of pivoting of the door leaves whereby there is an excellent seal as well as avoidance of risk of accidental injury.

2. A sliding folding door according to claim 1, characterized in that each of the connecting rail means further includes a pair of laterally spaced cylindrical second walls, said second walls are respectively associated with the first cylindrical walls and are radially spaced therefrom, each of the second cylindrical walls have an arcuate length of approximately a quarter-circle and a radius of curvature having a center point arranged in the pivot means, and in that a pair of second crosspieces are provided connected to and extending along a long side of the respective leaves of the door from the other of said inner and outer walls, one of said second crosspieces is disposed opposite one of the second cylindrical walls and the other of the second crosspieces is disposed opposite the other of the second cylindrical walls.

3. A sliding folding door according to claim 2, characterized in that further crosspieces connected to said shaped connecting rail means are provided, one of said further crosspieces connecting one of the first cylindrical walls with an associated second cylindrical wall, and a second of said further crosspieces connecting the other of the first cylindrical walls with an associated second cylindrical wall.

4. A sliding folding door according to claim 3, characterized in that a straight connecting piece is arranged between the pair of first cylindrical walls so as to bridge the lateral spacing therebetween, a joint means is provided for joining adjacent ends of the second cylindrical walls, said first and second cylindrical walls, said further crosspieces, said straight connecting piece, and said joint means defining a chamber, and in that insulating material is disposed in the chamber.

5. A sliding folding door according to claim 4, characterized in that sealing means are disposed along a length of each of the first and second crosspieces.

6. A sliding folding door according to claim 5, characterized in that each of the first cylindrical walls terminate in a short extended section, and sealing pad means being arranged at the other of the inner wall and outer wall of the respective door leaves such that the short extended sections abut the respective sealing pad means when the door is in a closed position.

7. A sliding folding door according to claim 6, characterized in that each of said further crosspieces have an end portion extending beyond the second cylindrical walls, said pivot means includes a pin means formed on a free end of at least one of said end portions, and wherein said pairs of first and second crosspieces are the legs of U-shaped connecting members connected to the respective longitudinal sides of the door leaves, and wherein one of the legs of at least one of the U-shaped members includes sleeve means for rotatably accommodating the pin means, and in that said sleeve means includes a longitudinal slit for enabling the pin means to rotate in the sleeve means.

8. A sliding folding door according to claim 2, characterized in that said pairs of first and second crosspieces are the legs of U-shaped connecting members connected to the longitudinal sides of the respective door leaves, a first leg of each connecting member being secured to the outer wall of a respective door leaf.

9. A sliding folding door according to claim 8, characterized in that means are provided for connecting said first and second cylindrical walls so as to define a hollow chamber, and in that insulating material is disposed in the hollow chamber.

10. A sliding folding door according to claim 9, characterized in that sealing means are disposed along a length of each of the first and second crosspieces between said crosspieces and the respective adjacent cylindrical walls.

11. A sliding folding door according to claim 10, characterized in that each of the first cylindrical walls terminate in a short extended section, and sealing pad means being arranged at the other of the inner wall and outer wall of the respective door leaves such that the short extended sections abut the sealing pad means when the door is in a closed position.

12. A sliding folding door according to claim 11, characterized in that the pivot means includes a hinge means connected to at least one of the first and second cylindrical walls and to one of the legs of a U-shaped connecting member.

13. A sliding folding door according to claim 12, characterized in that the pivot means includes a sleeve means provided on one of the legs of the U-shaped connecting member, a pin means is adapted to be rotatably accommodated in the sleeve means, the pin means being connected with at least one of the first and second cylindrical walls.

* * * * *